US006926754B2

(12) United States Patent
Shamblen et al.

(10) Patent No.: US 6,926,754 B2
(45) Date of Patent: Aug. 9, 2005

(54) METHOD FOR PREPARING METALLIC SUPERALLOY ARTICLES HAVING THERMOPHYSICALLY MELT INCOMPATIBLE ALLOYING ELEMENTS, WITHOUT MELTING

(75) Inventors: Clifford Earl Shamblen, Cincinnati, OH (US); Andrew Philip Woodfield, Cincinnati, OH (US); Eric Allen Ott, Cincinnati, OH (US); Michael Francis Xavier Gigliotti, Glenville, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/459,738

(22) Filed: Jun. 12, 2003

(65) Prior Publication Data

US 2005/0050997 A1 Mar. 10, 2005

(51) Int. Cl.[7] ..... B22F 3/00
(52) U.S. Cl. ..... 75/765; 419/66; 420/590
(58) Field of Search ..... 75/765; 419/66; 420/590

(56) References Cited

U.S. PATENT DOCUMENTS

| | | | |
|---|---|---|---|
| 4,894,086 A | 1/1990 | Huether et al. | |
| 5,322,666 A | 6/1994 | Watwe | |
| 5,779,761 A | 7/1998 | Armstrong et al. | |
| 5,930,580 A | 7/1999 | Everett | |
| 5,958,106 A | 9/1999 | Armstrong et al. | |
| 6,737,017 B2 * | 5/2004 | Woodfield et al. | 419/30 |
| 2004/0118245 A1 * | 6/2004 | Ott et al. | 75/351 |
| 2004/0159185 A1 * | 8/2004 | Shamblen et al. | 75/351 |

FOREIGN PATENT DOCUMENTS

WO WO 99/64638 12/1999

OTHER PUBLICATIONS

Doyle, Eoghan T. M. et al: "Carbothermic reduction of nickel–cobalt–chromium oxide mixture for the production of NiCoCr superalloy powder" EPD Congr. 1992, Proc. Symp. TMS Annu. Meet., 745–58. Editor(s): Hager, John P. Publisher: Miner. Met. Mater. Soc., Warrendale, PA. Coden: 58HHA7, 1992, XP0009029023.

* cited by examiner

*Primary Examiner*—Melvyn Andrews
(74) *Attorney, Agent, or Firm*—McNees Wallace & Nurick LLC

(57) ABSTRACT

An article of a base metal alloyed with an alloying element is prepared by mixing a chemically reducible nonmetallic base-metal precursor compound of a base metal and a chemically reducible nonmetallic alloying-element precursor compound of an alloying element to form a compound mixture. The base metal is nickel, cobalt, iron, iron-nickel, or iron-nickel-cobalt. One or more of the alloying elements are thermophysically melt incompatible with the base metal. The method further includes chemically reducing the compound mixture to a metallic superalloy, without melting the metallic superalloy, and thereafter consolidating the metallic superalloy to produce a consolidated metallic article, without melting the metallic superalloy and without melting the consolidated metallic article.

20 Claims, 2 Drawing Sheets

METHOD FOR PREPARING METALLIC SUPERALLOY ARTICLES HAVING THERMOPHYSICALLY MELT INCOMPATIBLE ALLOYING ELEMENTS, WITHOUT MELTING

This invention relates to the fabrication of a metallic superalloy material and article using a procedure in which the metallic superalloy is never melted.

BACKGROUND OF THE INVENTION

Superalloys are high-temperature, oxidation-resistant alloys with high strength levels. These superalloys have wide application in the aircraft propulsion industry and are also used in other industries such as automotive and chemical processing. Superalloy metallic articles are fabricated by any of a number of techniques, as may be appropriate for the nature of the metal and the article. In one common approach, metal-containing ores are refined to produce molten metal, which is thereafter cast. Ore refinement may take place separately for each of the major alloying elements, or in combination for more than one element. Elements and combinations of elements may take many intermediate forms before being melted to form the final alloy. The metal is refined as necessary to remove or reduce the amounts of undesirable minor elements. The composition of the refined metal may also be modified by the addition of desirable alloying elements. These refining and alloying steps may be performed during the initial melting process or during remelting. After a superalloy of the desired composition is produced, it may be used in the as-cast form for some superalloy compositions (i.e. cast superalloys), or it may be cast and further worked to form the metal to the desired shape for other superalloy compositions (i.e. wrought superalloys). It may instead be atomized to form fine powder and subsequently consolidated and, in some cases, further worked (i.e. powder metallurgy superalloys). In any case, further processing such as joining, heat treating, machining, surface coating, and the like may be employed.

Regardless of processing route, all of these forms involve melt processing and are, as a result, subject to restrictions imposed by such processes. Melting of superalloy materials is typically accomplished using multiple melt processes in order to refine undesirable residual element content, to homogenize the overall composition, adjust the alloy content, and cast the final ingot or article. In multiple melt processes, intermediate cast electrodes are produced which serve as the input stock to the subsequent melting step. Melting processes include those which are not performed under vacuum such as electroslag remelting and electric arc furnace melting followed by argon-oxygen decarburization, and those which are performed under vacuum such as vacuum induction melting and vacuum arc remelting. Non-vacuum processes require the use of refining and protective slags during the melting process.

Additional limitations are also imposed as a result of the melting process for superalloys because of their compositions and the propensity for formation of melt-related irregularities. Alloy composition and resulting segregation issues during solidification impose practical limits on the melting rate and the maximum electrode or ingot diameters, which can be produced without gross irregularities. In order to reduce the incidence of melt-related irregularities, strict melt controls are imposed so as to monitor and control melt rate, heat input, melt temperature, electrode-to-crucible clearance, and other critical parameters. Inadequate control of these parameters can result in material with significant solidification-related irregularities, which, in turn, can reduce yield and increase production costs. In cases, such as in vacuum induction melting, where one alloy is melted in the ceramic melt crucible, and then a second alloy of a different alloy is to be subsequently melted in the same vessel, an intermediate "wash heat" is required in order to minimize alloying element contamination from one alloy to the next which may result from residual alloy material remaining on the crucible wall. This wash-heat requirement adds to the overall cost of producing high-quality superalloy material.

Irregularities may result from melting processes or as a result of subsequent forming operations. Melt-related irregularities include those related to segregation as well as those resulting from extrinsic contaminants such as air and crucible ceramics. Melting of superalloys is subject to significant solidification segregation that can result in the formation of irregularities such as freckles, eutectic nodules, and white spots. Freckles are the result of alloying element partitioning during solidification, and are most prevalent in those materials that are highly alloyed to achieve improved properties. White spots, likewise, are a result of alloying element segregation, but can also be associated with extrinsic contamination from crucible ceramics or remnant slag inclusions (dirty white spots). These melt-related irregularities can significantly degrade the fatigue resistance of the superalloy material. Melt-related irregularities can also contribute to forging-related irregularities such as cracking. Some highly alloyed materials are also more difficult to form as a result of inheriting the coarse cast structure, which can lead to additional forging-related irregularities.

Some superalloys are also produced using powder metallurgy processes to circumvent these segregation irregularity issues, particularly for large-diameter ingots, and to reduce the size of extrinsic contaminants resulting from the multiple melt process. The current powder metallurgy processes, however, require superalloy material to first be melted to produce alloy ingot, and then remelted and atomized to produce powder. These powder metallurgy processes add great expense and can still result in extrinsic contamination from crucible ceramics and slag. In addition, powder metallurgy processes are also subject to concerns related to inert gas entrapment in powder particles during the atomization process, which can lead to residual porosity in the resulting billet or component. These irregularities can degrade the fatigue properties of articles produced by the current powder metallurgy process.

Although conventionally produced superalloys possess high-temperature strength, corrosion resistance, and oxidation resistance, increasingly more severe application service conditions result in the need for further improvements in strength, temperature capability, and environmental resistance. Revolutionary improvements in these properties have not been largely possible due to compositional constraints imposed by melting and working processes. Significant improvements in corrosion and oxidation protection are required to improve the service temperature and time limitations with current alloys. These limitations may not be addressed currently or may only be addressed through application of additional coatings.

The production of some desirable compositions of superalloys may be complicated by the differences in the thermophysical properties of the metals being combined to produce the alloy. The interactions and reactions due to these thermophysical properties of the metals may cause undesired results. To cite one example, base metals such as nickel, cobalt, and iron are, in some cases, melted in a vacuum to ensure low oxygen and nitrogen contents in the final alloys. In the work leading to the present invention, the inventors have realized that the necessity to melt under a vacuum makes it difficult to utilize some desirable alloying elements due to their relative vapor pressures in a vacuum environment. The difference in the vapor pressures is one of the thermophysical properties that must be considered in alloying such base metals. In other cases, the alloying elements may be thermophysically melt incompatible with the molten base metal because of other thermophysical characteristics such as miscibilities, melting points, densities, and chemical reactivities or may have limitations in alloy content due to solidification reactions which form undesirable phase morphologies. Some of the incompatibilities may be overcome with the use of expensive master alloys, but this approach is not applicable in other cases.

As a result, the inventors have recognized in the work leading to the present invention that melting processes impose significant compositional and structural limitations on the resulting article. Incremental performance improvements resulting from processing modifications and incremental improvements in production cost reduction are still possible in a number of areas. However, in other instances the fabrication approach involving multiple melt steps imposes fundamental performance limitations that cannot be overcome at any reasonable cost. They have recognized a need for a departure from the conventional thinking in fabrication technology, which will overcome many of these fundamental limitations. The present invention fulfils this need, and further provides related advantages.

BRIEF SUMMARY OF THE INVENTION

The present invention provides a method for preparing an article made of a superalloy composition that includes a thermophysically melt-incompatible alloying element. The present approach circumvents problems, which cannot be avoided in melting practice or are circumvented only with great difficulty and expense. The present approach permits a uniform alloy to be prepared without subjecting the constituents to the processing which leads to the incompatibility, specifically the melting process. Unintentional oxidation of the reactive metal and the alloying elements is also avoided. The present approach permits the preparation of articles with compositions that may not be otherwise readily prepared in commercial quantities. Master alloys are not used.

A method for preparing an article of a base metal alloyed with an alloying element comprises the steps of providing a chemically reducible nonmetallic base-metal precursor compound of a base metal selected from the group consisting of nickel, cobalt, iron, iron-nickel, and iron-nickel-cobalt, and providing a chemically reducible nonmetallic alloying-element precursor compound of an alloying element, wherein the alloying element is thermophysically melt incompatible with the base metal. The base-metal precursor compound and the alloying-element precursor compound are thereafter mixed to form a compound mixture, and the compound mixture is thereafter chemically reduced to produce a metallic superalloy without melting the metallic superalloy. The metallic superalloy is thereafter consolidated to produce a consolidated metallic article, without melting the metallic superalloy and without melting the consolidated metallic article.

As used herein, a "superalloy" is a nickel-base, cobalt-base, iron-base, iron-nickel-base, or iron-nickel-cobalt-base alloy having at least two phases, including a continuous matrix phase with a face-centered-cubic crystal structure that is strengthened by both solid solution strengthening and the presence of one or more additional discrete phases that are distributed throughout the matrix phase, where the discrete phases have a different composition than the matrix phase. The strengthening discrete phase or phases present in the superalloy in its fully heat treated, service condition-form, is at least about 5 percent by volume in the case of iron-base alloys, at least about 10 percent by volume in the case of nickel-base, iron-nickel-base, and iron-nickel-cobalt-base alloys, and at least about 1 percent by volume in the case of cobalt-base alloys.

An "X-base" alloy is defined as having more of metallic element(s) X than any other single element, and in many cases has more than 50 percent by weight of element(s) "X". That is, a nickel-base alloy has more nickel than any other element; a cobalt-base alloy has more cobalt than any other element; an iron-base alloy has more iron than any other element; an iron-nickel-base alloy has more of the sum of (iron plus nickel) than any other element; and an iron-nickel-cobalt-base alloy has more of the sum of (iron plus nickel plus cobalt) than any other element.

The nonmetallic precursor compounds may be solid, liquid, or gaseous. The chemical reduction is preferably performed by solid-phase reduction, such as fused salt electrolysis of the precursor compounds in a finely divided solid form such as an oxide of the element; or by vapor-phase reduction, such as contacting vapor-phase halides of the base metal and the alloying element(s) with a liquid alkali metal or a liquid alkaline earth metal.

The thermophysical melt incompatibility of the alloying element with the base metal may be any of several types, and some examples follow. Specific examples of thermophysical melt incompatibility for nickel-base alloys, the presently most preferred superalloy base metal, are given. In the alloys, there are one or more thermophysically melt incompatible elements. Additionally, there may be, and usually are, one or more elements that are not thermophysically melt incompatible with the base metal. Some elements are not thermophysically melt incompatible when present in a "compatible" composition range (usually but not necessarily smaller amounts), but are thermophysically melt incompatible when present in an "incompatible" composition range (usually but not necessarily larger amounts). As used herein, such elements are considered to be thermophysically melt incompatible elements only when present in an amount within the incompatible composition range, and are not considered to be thermophysically melt incompatible elements when present in an amount outside the incompatible composition range.

One such thermophysical melt incompatibility is in the vapor pressure, as where the alloying element has an evaporation rate of greater than about 10 times that of the base metal at a melt temperature, which is preferably a temperature just above the liquidus temperature of the alloy. Examples of such alloying elements for nickel-base alloys include bismuth, cadmium, calcium, magnesium, and chromium.

Another such thermophysical melt incompatibility occurs when the melting point of the alloying element is too high or too low to be compatible with that of the nickel, cobalt, or iron base metal, as where the alloying element has a melting point different from (either greater than or less than) that of the base metal of more than about 400° C. (720° F.). Examples of such alloying elements for nickel-base alloys include cadmium, gallium, hafnium, indium, lanthanum, magnesium, niobium, rhenium, and tantalum. Some of these elements may be furnished in master alloys whose melting points are closer to that of the base metal such as nickel, but the master alloys are often expensive.

Another such thermophysical melt incompatibility occurs when the density of the alloying element is so different from that of the nickel, cobalt, or iron base metal that the alloying element physically separates in the melt, as where the alloying element has a density difference with the base metal of greater than about 0.5 gram per cubic centimeter. Examples of such alloying elements for nickel-base alloys include tungsten, molybdenum, niobium, and tantalum.

Another such thermophysical melt incompatibility occurs when the alloying element, or a chemical compound formed between the alloying element and the base metal, chemically reacts with the base metal in the liquid phase to form a solid phase or compound. Examples of such alloying elements for nickel-base alloys include erbium, europium, gadolinium, lanthanum, nitrogen, neodymium, and yttrium.

Another such thermophysical melt incompatibility is where the alloying element exhibits a miscibility gap with the base metal in the liquid phase. Examples of such alloying elements for nickel-base alloys include silver, barium, lithium, lead, and thallium.

Another such thermophysical melt incompatibility occurs due to elemental segregation during solidification, which causes an unacceptable distribution of the alloying element in the solidified ingot. The degree of segregation may be reduced in melted-and-cast product by lowering the melting power, reducing the ingot diameter, using long post-casting homogenization heat treatments, and the like, but these prior approaches increase cost and limit the type of product that may be produced. In the present process, this type of segregation is avoided because the alloy is never melted and solidified. Examples of such segregating alloying elements for nickel-base alloys include arsenic, gold, beryllium, calcium, cadmium, chromium, gadolinium, germanium, hafnium, indium, scandium, silicon, tantalum, zirconium, and zinc.

Another thermophysical incompatibility is not strictly related to the nature of the base metal, but instead to the crucibles or environment in which the base metal is melted. Base metals may require the use of a particular crucible material or melting atmosphere, and some potential alloying elements may react with those crucible materials or melting atmospheres, and therefore not be candidates as alloying elements for that particular base metal. Examples of such incompatible alloying elements for nickel-base alloys include hafnium, lanthanum, calcium, and cerium.

These and other types of thermophysical melt incompatibilities lead to difficulty or impossibility in forming acceptable alloys of these elements in a conventional melting practice. The present approach, in which the metals are not melted at all during production or processing, circumvents the thermophysical melt incompatibility to produce good quality, homogeneous alloys.

The mixture of the nonmetallic precursor compounds may be produced in any operable form. For example, the mixture may be furnished as a compressed mass of particles, powders, or pieces of the nonmetallic precursor compounds, which typically has larger external dimensions than a desired final metallic article. The compressed mass may be formed by pressing and sintering. In another example, the mixture of the nonmetallic precursor compounds may be finely divided particulate or powder, and not compressed to a specific shape. In another example, the mixture may be a mixture of vapors of the precursor compounds.

The compound mixture may optionally be compacted, after the step of mixing and before the step of chemical reduction. The result is a compacted mass which, when chemically reduced, produces a spongy metallic material.

After the chemical reduction step, the metallic alloy is consolidated to produce a consolidated metallic article, without melting the metallic superalloy and without melting the consolidated metallic article. This consolidation may be performed with any physical form of the metallic alloy produced by the chemical reduction. Consolidation is preferably performed by hot pressing or hot isostatic pressing, or extrusion, but without melting in each case. Solid state diffusion of the alloying elements may also be used to achieve the consolidation.

Optionally, prior to the step of consolidating, a mixture of the metallic material and an "other additive constituent" may be produced to make the superalloy composition.

The consolidated metallic article may be used in the as-consolidated form. In appropriate circumstances, it may be formed to other shapes using known forming techniques such as rolling, forging, extrusion, and the like. It may also be post-processed by known techniques such as joining, machining, heat treating, surface coating, and the like.

The present approach differs from prior approaches in that the metal is not melted on a gross scale. Melting and its associated processing such as casting are expensive and also produce some undesirable microstructures that either are unavoidable or can be altered only with additional expensive processing modifications. The present approach reduces cost and avoids structures and irregularities associated with melting and casting, to improve mechanical properties of the final metallic article. It also results in some cases in an improved ability to fabricate specialized shapes and forms more readily, and to inspect those articles more readily.

One embodiment of the present approach also has the advantage of being based in a powder-form precursor. Starting with a powder of the nonmetallic precursor compounds avoids a cast structure with its associated irregularities such as elemental segregation on a nonequilibrium microscopic and macroscopic level, a cast microstructure with a range of grain sizes and morphologies that must be homogenized in some manner for many applications, gas entrapment, and contamination. The present approach produces a uniform, fine-grained, homogeneous, pore-free, gas-pore-free, and low-contamination final product.

The fine-grain structure of the sponge or powder superalloy material provides an excellent starting point for subsequent consolidation and metalworking procedures such as forging, hot isostatic pressing, rolling, and extrusion. The finer grain size aids workability because the material moves into a superplastic working range. Conventional cast starting material must be extensively worked to modify and reduce the cast structure, and such extensive working is not necessary with the present approach.

Another important benefit of the present approach is improved inspectability as compared with cast-and-wrought product. Large metallic articles used in fracture-critical applications are inspected multiple times during and at the conclusion of the fabrication processing. Cast-and-wrought product made of metals and used in critical applications such as gas turbine disks exhibits a high noise level in ultrasonic inspection due to the microstructure produced during melting, casting, and processing. The presence of this microstructure limits the ability to inspect for small irregularities.

The superalloy articles produced by the present approach are of a fine grain size and are free of microstructures discussed previously that inhibit inspectability. As a result, they exhibit a significantly reduced noise level during ultrasonic inspection, and permit inspection for smaller irregularities. The reduction in size of irregularities that may be detected allows larger articles to be fabricated and inspected, thus permitting more economical fabrication procedures to be adopted, and/or the detection of smaller irregularities. By reducing the noise associated with the inspection procedure, larger diameter intermediate-stage articles may be processed and inspected. Processing steps and costs are reduced, and there is greater confidence in the inspected quality of the final product. The resultant article that contains fewer and smaller irregularities also results in improved mechanical properties.

The present approach is advantageously applied to make superalloy articles (nickel-base articles, cobalt-base articles, iron-base articles, iron-nickel-base articles, and iron-nickel-cobalt-base articles). Contamination and other impurity elements that are almost unavoidable in conventional casting practice, and which may have major adverse effects on the properties of the material, may be eliminated with the present approach. The structure is more uniform and homogeneous than may be produced by conventional casting and working techniques. For the material produced by the present approach that replaces conventionally cast material, there is a reduced incidence of irregularities such as those produced by segregation and inclusions (e.g., white spots, freckles, eutectic nodules, and banding) during conventional casting operations, and those associated with remelted/recycled material. The cost is also reduced due to the elimination of processing steps associated with casting. The reduction in the cost of the final product achieved by the present approach also makes the superalloys more economically competitive with otherwise much less-expensive materials such as low-cost ferritic and martensitic steels in cost-driven applications. Properties are also improved. Additionally, large-sized specialty articles, whose size is limited only by compaction capability, may be made while avoiding microsegregation and macrosegregation. Reduced thermomechanical work is required to produce fine microstructures, and there is reduced loading on the mechanical working equipment. Fine-grained microstructures are also more amenable to superplastic forming. More complex processing may be used, because of the initially fine microstructure.

The present approach thus allows the production of new alloys that cannot be made with the present melting-and-casting technology because of thermophysical incompatibility.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
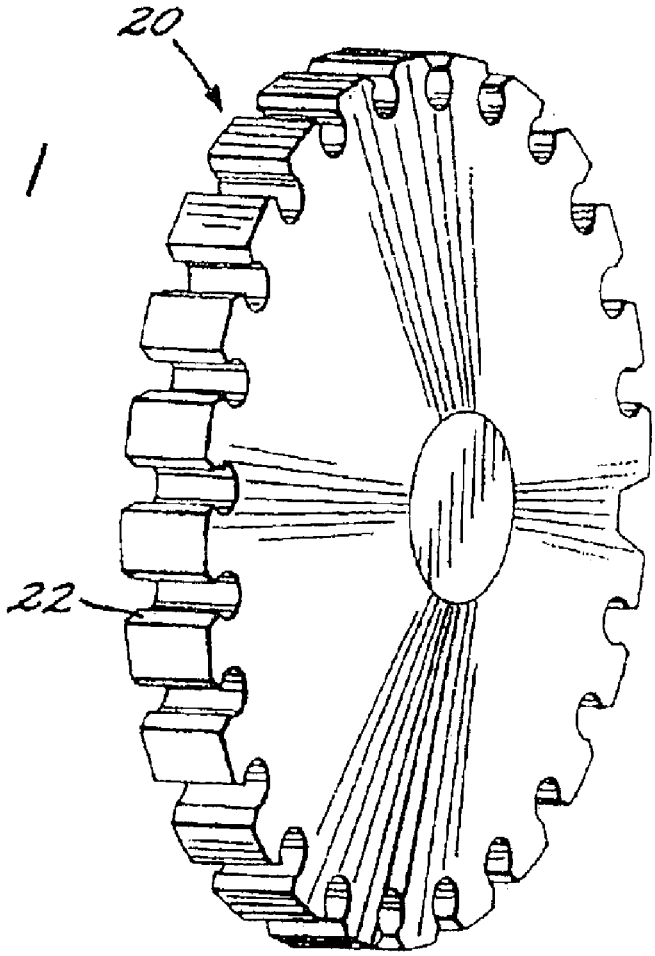
FIG. 1 is a perspective view of a metallic article prepared according to the present approach.

The present approach may be used to make a wide variety of metallic articles 20, as depicted in FIG. 1, such as a component of a gas turbine engine. The illustrated consolidated metallic article 20 is a turbine disk, with slots 22 in the rim that are subsequently machined after the consolidation. A respective turbine blade is received into each slot 22. Some other examples include other gas turbine components such as compressor disks, compressor blades and vanes, turbine vanes and blades, bearings, blisks, cases, shafts, automobile parts, biomedical articles, structural members such as airframe parts, and rocket engine and other propulsion systems components. There is no known limitation on the types of articles that may be made by this approach.

Figure 2:
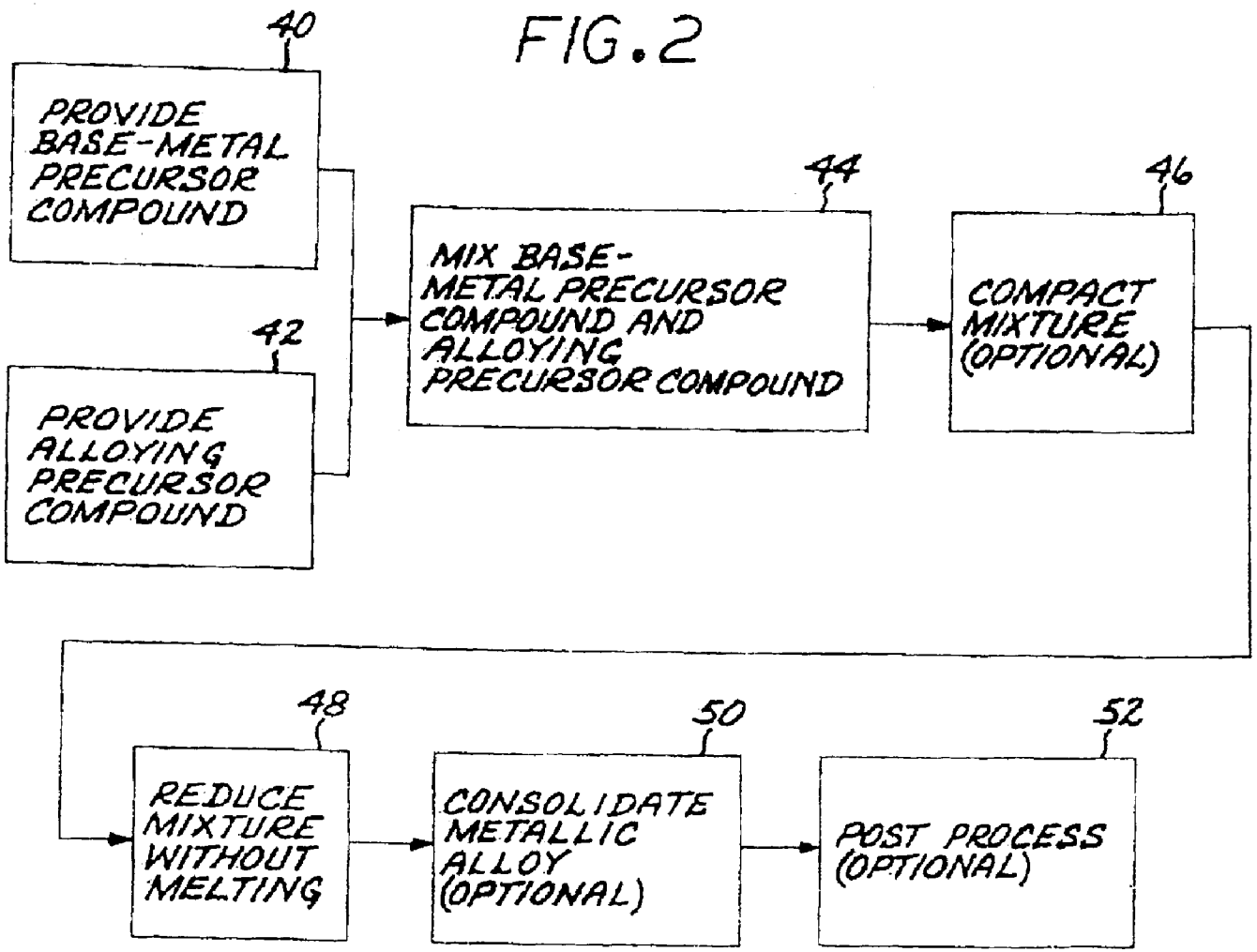
FIG. 2 is a block flow diagram of an approach for practicing the invention.

FIG. 2 illustrates a preferred approach for an article of a base metal and a thermophysically melt-incompatible alloying element. The method comprises providing a chemically reducible nonmetallic base-metal precursor compound, step 40, and providing a chemically reducible nonmetallic alloying-element precursor compound of an alloying element that is thermophysically melt incompatible with the base metal, step 42. "Nonmetallic precursor compounds" are nonmetallic compounds of the metals that eventually constitute the metallic article 20. Any operable nonmetallic precursor compounds may be used. Reducible oxides of the metals are the preferred nonmetallic precursor compounds in solid-phase reduction, but other types of nonmetallic compounds such as sulfides, carbides, halides, and nitrides are also operable. Reducible halides of the metals are the preferred nonmetallic precursor compounds in vapor-phase reduction. The base metal is a metal that is present in a greater percentage by weight than any other element in the alloy. The base-metal compound is present in an amount such that, after the chemical reduction to be described subsequently, there is more of the base metal present in the metallic alloy than any other element. In the most preferred case of nickel base metal, the base-metal precursor compound is preferably nickel oxide for solid-phase reduction or nickel chloride for vapor-phase reduction. The alloying element may be any element that is available in the chemically reducible form of the precursor compound.

The nonmetallic precursor compounds are furnished in any operable physical form. The nonmetallic precursor compounds used in solid-phase reduction are preferably initially in a finely divided form to ensure that they are chemically reacted in the subsequent step. Such finely divided forms include, for example, powder, granules, flakes, or pellets that are readily produced and are commercially available. The nonmetallic precursor compounds in this finely divided form may be processed through the remainder of the procedure described below. In a variation of this approach, the finely divided form of the nonmetallic precursor compounds may be compressed together, as for example by pressing and sintering, to produce a preform that is processed through the remainder of the procedure. In the latter case, the compressed mass of nonmetallic precursor compounds is larger in external dimensions than a desired final metallic article, as the external dimensions are reduced during the subsequent processing.

The superalloy produced by the present approach is nickel-base, cobalt-base, iron-base, iron-nickel-base, or iron-nickel-cobalt-base. An "X-base" alloy is defined as having more of metallic element(s) X than any other single element, and in many cases has more than 50 percent by weight of element(s) "X". The nonmetallic precursor compounds are selected to provide the necessary metals in the final metallic article, and are mixed together in the proper proportions to yield the necessary proportions of these metals in the final metallic article. For example, if the final article were to have a composition comparable to Rene™ 88 alloy, but modified to improve environmental resistance, with a nominal composition in weight percent of 16 percent chromium, 54.5 weight percent nickel, 13 weight percent cobalt, 4 weight percent molybdenum, 4 weight percent tungsten, 0.7 weight percent niobium, 3.7 weight percent titanium, 2.1 weight percent aluminum, 2 weight percent (lanthanum plus hafnium), balance minor elements, the nonmetallic precursor compounds in amounts to provide these proportions of the metallic are provided. (Minor alloying elements may also be provided in the precursor compounds.) The precursor compounds are furnished and mixed together in the correct proportions such that the ratio of the desired elements in the mixture of precursor compounds is that required to form the metallic superalloy in the final article. Nonmetallic precursor compounds that serve as a source of more than one of the metals in the final metallic article may also be used. Similar principles apply for other superalloys.

The present approach is utilized in conjunction with thermophysically melt incompatible alloys. "Thermophysical melt incompatibility" and related terms refer to the basic concept that any identified thermophysical property of an alloying element is sufficiently different from that of the base metal to cause detrimental effects in the melted final product. These detrimental effects include phenomena such as chemical inhomogeneity (detrimental micro-segregation, macro-segregation, and gross segregation from vaporization or immiscibility), inclusions of the alloying elements such as high-density inclusions, and the like. Thermophysical properties are intrinsic to the elements, and combinations of the elements which form alloys, and are typically envisioned using equilibrium phase diagrams, vapor pressure versus temperature curves, curves of densities as a function of crystal structure and temperature, and similar approaches. Although alloy systems may only approach predicted equilibrium, these envisioning data provide information sufficient to recognize and predict the cause of the detrimental effects as thermophysical melt incompatibilities. However, the ability to recognize and predict these detrimental effects as a result of the thermophysical melt incompatibility does not eliminate them. The present approach provides a technique to minimize and desirably avoid the detrimental effects by the elimination of melting in the preparation and processing of the alloy.

Thus, "thermophysical melt incompatible" and related terms mean that the alloying element or elements in the alloy to be produced do not form a well mixed, homogeneous alloy with the base metal in a production melting operation in a stable, controllable fashion. In some instances, a thermophysically melt incompatible alloying element cannot be readily incorporated into the alloy at any compositional level, and in other instances the alloying element can be incorporated at low levels but not at higher levels. For example, some elements do not behave in a thermophysically melt incompatible manner when introduced at low levels, and homogeneous alloys of such alloying additions may be prepared. However, if there is an attempt to introduce greater levels of such elements, they tend to segregate strongly in the melt and thus behave in a thermophysically melt incompatible manner so that homogeneous alloys can only be prepared with great difficulty or not at all. The precise composition range of the thermophysical melt incompatibility may depend upon the processing route (e.g., cast, cast-and-wrought, or powder) of the alloy.

The thermophysical melt incompatibility of the alloying element with nickel, cobalt, iron, iron-nickel, or iron-nickel-cobalt base metal may be any of several types, and some examples follow.

One such thermophysical melt incompatibility is in the vapor pressures, as where the alloying element has an evaporation rate of greater than about 10 times that of the base metal at a melt temperature, which is preferably a temperature just above the liquidus temperature of the alloy. Examples of such alloying elements for nickel-base alloys include bismuth, cadmium, calcium, magnesium, and chromium. Where the vapor pressure of the alloying element is too high, it will preferentially evaporate, as indicated by the evaporation rate values, when co-melted with nickel, cobalt, iron, iron-nickel, or iron-nickel-cobalt base metals under a vacuum in conventional melting practice. An alloy will be formed, but it is not stable during melting and continuously loses the alloying element so that the percentage of the alloying element in the final alloy is difficult to control. In the present approach, because there is no vacuum melting, the high melt vapor pressure of the alloying element is not a concern.

Another such thermophysical melt incompatibility occurs when the melting point of the alloying element is too high or too low to be compatible with that of the nickel, cobalt, or iron base metal, as where the alloying element has a melting point different from (either greater than or less than) that of the base metal of more than about 400° C. (720° F.). Examples of such alloying elements for nickel-base alloys include cadmium, gallium, hafnium, indium, lanthanum, magnesium, niobium, rhenium, and tantalum. Some of these elements may be furnished in master alloys whose melting points are closer to that of the base metal such as nickel, but the master alloys are often expensive. If the melting point of the alloying element is too high, it is difficult to melt and homogenize the alloying element into the melt in conventional vacuum melting practice. The segregation of such alloying elements may result in the formation of high-density inclusions containing that element. If the melting point of the alloying element is too low, it will likely have an excessively high vapor pressure at the temperature required to melt the base metal. In the present approach, because there is no melting, the overly high or low melting points are not a concern.

Another such thermophysical melt incompatibility occurs when the density of the alloying element is so different from that of the nickel, cobalt, or iron base metal that the alloying element physically separates in the melt, as where the alloying element has a density difference with the base metal of greater than about 0.5 gram per cubic centimeter. Examples of such alloying elements for nickel-base alloys include tungsten, molybdenum, niobium, and tantalum. In conventional melting practice, the overly high or low density leads to gravity-driven segregation of the alloying element. In the present approach, because there is no melting there can be no gravity-driven segregation.

Another such thermophysical melt incompatibility occurs when the alloying element, or a chemical compound formed between the alloying element and the base metal, chemically reacts with the base metal in the liquid phase. Examples of such alloying elements for nickel-base alloys include erbium, europium, gadolinium, lanthanum, nitrogen, neodymium, and yttrium. In conventional melting practice, the chemical reactivity of the alloying element with the base metal leads to the formation of intermetallic compounds including the base metal and the alloying element, and/or other deleterious phases in the melt, which are retained after the melt is solidified. These phases, partially because of their agglomerated sizes, often have adverse effects on the properties of the final alloy. In the present approach, because the metals are not heated to the point where these reactions occur, the compounds are not formed or are not formed in deleterious phase distributions.

Another such thermophysical melt incompatibility is the result of a miscibility gap between the alloying element and the base metal in the liquid phase. Examples of such alloying elements for nickel-base alloys include silver, barium, lithium, lead, and thallium. In conventional melting practice, a miscibility gap leads to a segregation of the melt into the compositions defined by the miscibility gap. The result is inhomogeneities in the melt, which are retained in the final solidified article. The inhomogeneities lead to variations in properties throughout the final article. In the present approach, because the elements are not melted, the miscibility gap is not a concern.

Another such thermophysical melt incompatibility occurs due to elemental segregation during solidification, which causes an unacceptable phase distribution of the alloying element in the solidified ingot. The degree of segregation may be reduced in melted-and-cast product by lowering the melting power, reducing the ingot diameter, using long post-casting homogenization heat treatments, and the like, but these prior approaches increase cost and limit the type of product that may be produced. In the present process, this type of segregation is avoided because the alloy is never melted and solidified. Examples of such segregating alloying elements for nickel-base alloys include arsenic, gold, beryllium, calcium, cadmium, chromium, gadolinium, germanium, hafnium, indium, scandium, silicon, tantalum, zirconium, and zinc. The segregation of elements in conventional melting-and-casting practice results in adverse effects on mechanical properties as well as physical properties such as corrosion, oxidation, and sulfidization resistance.

Another thermophysical incompatibility is not strictly related to the nature of the base metal, but instead to the crucibles or environment in which the base metal is melted. Base metals may require the use of a particular crucible material or melting atmosphere, and some potential alloying elements may chemically react with those crucible materials or melting atmospheres, and therefore not be candidates as alloying elements for that particular base metal. Examples of such incompatible alloying elements for nickel-base alloys include hafnium, calcium, lanthanum, and cerium.

These and other types of thermophysical melt incompatibilities lead to difficulty or impossibility in forming acceptable alloys of these elements in conventional production vacuum melting. Their adverse effects are avoided in the present melt-less approach.

The base-metal compound and the alloying compound are mixed to form a uniform, homogeneous compound mixture, step 44. The mixing is performed by conventional procedures used to mix powders in other applications, for solid-phase reduction, or by the mixing of the vapors, for vapor-phase reduction. The chemical composition of the metallic alloy is determined by the types and amounts of the metals in the mixture of nonmetallic precursor compounds furnished in steps 40 and 42. The relative proportions of the metallic elements are determined by their respective ratios in the mixture of step 44 (not be the respective ratios of the compounds, but the respective ratios of the metallic elements).

Optionally, for solid-phase reduction of solid precursor compound powders the compound mixture is compacted to make a preform, step 46. This compaction is conducted by cold or hot pressing of the finely divided compounds, but not at such a high temperature that there is any melting of the compounds. The compacted shape may be sintered in the solid state to temporarily bind the particles together. The compacting desirably forms a shape similar to, but larger in dimensions than, the shape of the final article.

The mixture of nonmetallic precursor compounds is thereafter chemically reduced by any operable technique to produce a metallic material, without melting the metallic material, step 48. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperature of the superalloy that forms from the nonmetallic precursor compounds. The mixture of nonmetallic precursor compounds is made the cathode of the electrolysis cell, with an inert anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature. The cathodic potential is controlled to ensure that the reduction of the nonmetallic precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a low level. The chlorides and mixtures of chlorides of barium, calcium, ccsium, lithium, strontium, and yttrium are preferred as the molten salt. The chemical reduction may be carried to completion, so that the nonmetallic precursor compounds are completely reduced. Not carrying the process to completion is a method to control the oxygen content of the metal produced.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. In one embodiment, a mixture of appropriate gases in the appropriate amounts is contacted to molten sodium, so that the metallic halides are reduced to the metallic form. The metallic superalloy is separated from the sodium. This reduction is performed at temperatures below the melting point of the metallic superalloy, so that the superalloy is not melted. The general processing approach is described more fully in U.S. Pat. Nos. 5,779,761 and 5,958,106, whose disclosures are incorporated by reference in their entireties.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, a carbon-containing gas may be mixed with the gaseous nonmetallic precursor compound(s) to increase the level of carbon in the superalloy material. Similarly, elements such as sulfur, nitrogen, and boron may be added using appropriate gaseous compounds of these elements. Complex combinations of such gaseous elements may be provided and mixed together, such as gaseous compounds of nitrogen, sulfur, carbon, and/or boron, leading to matrix phase dissolution of such additive elements or to the formation of chemically more-complex second phases.

Figure 3:
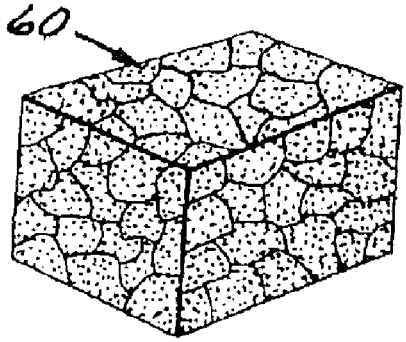
FIG. 3 is a perspective view of a spongy mass of the metallic material.

The physical form of the metallic superalloy material at the completion of step 48 depends upon the physical form of the mixture of nonmetallic precursor compounds at the beginning of step 48. If the mixture of nonmetallic precursor compounds is free-flowing, finely divided solid particles, powders, granules, pieces, or the like, the metallic superalloy material is also in the same form, except that it is smaller in size and typically somewhat porous. If the mixture of nonmetallic precursor compounds is a compressed mass of the finely divided solid particles, powders, granules, pieces, or the like, then the final physical form of the metallic superalloy material is typically in the form of a somewhat porous metallic sponge 60, as shown in FIG. 3. The external dimensions of the metallic sponge article are smaller than those of the compressed mass of the nonmetallic precursor compound due to the removal of the oxygen and/or other combined elements in the reduction step 48. If the mixture of nonmetallic precursor compounds is a vapor, then the final physical form of the metallic superalloy is typically fine or sponge-like powder that may be further processed.

Some constituents, termed "other additive constituents", may be difficult to introduce into the superalloy material. For example, suitable nonmetallic precursor compounds of the constituents may not be available, or the available nonmetallic precursor compounds of the other additive constituents may not be readily chemically reducible in a manner or at a temperature consistent with the chemical reduction of the other nonmetallic precursor compounds. It may be necessary that such other additive constituents ultimately be present as elements in solid solution in the superalloy material, as compounds formed by reaction with other constituents of the superalloy material, or as already-reacted, substantially inert compounds dispersed through the superalloy material. These other additive constituents or precursors thereof may be introduced from the gas, liquid, or solid phase, as may be appropriate, using one of the four approaches subsequently described or other operable approaches.

In a first approach, the other additive constituents are furnished as elements or compounds and are mixed with the precursor compounds prior to or concurrently with the step of chemically reducing. The mixture of precursor compounds and other additive constituents is subjected to the chemical reduction treatment of step 48, but only the precursor compounds are actually reduced and the other additive constituents are not reduced.

In a second approach, the other additive constituents in the form of solid particles are furnished but are not subjected to the chemical reduction treatment. Instead, they are mixed with the initial metallic material that results from the chemical reduction step, but after the step of chemically reducing 48 is complete. This approach is particularly effective when the step of chemically reducing is performed on a flowing powder of the precursor compounds, but it also may be performed on a pre-compacted mass of the precursor compounds, resulting in a spongy mass of the initial metallic material. The other additive constituents are adhered to the surface of the powder or to the surface of, and into the porosity of, the spongy mass.

In a third approach, the precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, from the gaseous phase. In one technique, a gaseous precursor or elemental form (e.g., methane or nitrogen gas) is flowed over surface of particle or sponge to deposit the element onto the surface from the gas.

A fourth approach is similar to the third approach, except that the other additive constituent is deposited from a liquid rather than from a gas. The precursor is first produced as powder particles, or as a sponge by compacting the precursor compounds of the metallic elements. The particles are, or the sponge is, then chemically reduced. The other additive constituent is thereafter produced at the surfaces (external and internal, if the particles are spongelike) of the particles, or at the external and internal surfaces of the sponge, by deposition from the liquid. In one technique, the particulate or sponge is dipped into a liquid solution of a precursor compound of the other additive constituent to coat the surfaces of the particles or the sponge. The precursor compound of the other additive constituent is second chemically reacted to leave the other additive constituent at the surfaces of the particles or at the surfaces of the sponge. In an example, lanthanum may be introduced into the superalloy material by coating the surfaces of the reduced particles or sponge (produced from the precursor compounds) with lanthanum chloride. The coated particles are, or the sponge is, thereafter heated and/or exposed to vacuum to drive off the chlorine, leaving lanthanum at the surfaces of the particles or sponge.

Whatever the reduction technique used in step 48 and however the other additive constituent is introduced, the result is a mixture that comprises the novel superalloy composition. The metallic superalloy material may be free-flowing particles in some circumstances, or have a sponge-like structure in other cases. The sponge-like structure is produced in the solid-phase reduction approach if the precursor compounds have first been compacted together prior to the commencement of the actual chemical reduction. The precursor compounds may be compressed to form a compressed mass that is larger in dimensions than a desired final metallic article.

The as-reduced metallic superalloy material is typically in a form that is not structurally useful for most applications. Accordingly, the metallic superalloy material is thereafter consolidated to produce a consolidated metallic article, without melting the metallic superalloy material and without melting the consolidated metallic article, step 50. The consolidation removes porosity from the metallic superalloy material, desirably increasing its relative density to or near 100 percent. Any operable type of consolidation may be used. Preferably, the consolidation 50 is performed by hot isostatic pressing the metallic superalloy material under appropriate conditions of temperature and pressure, but at a temperature less than the melting points of the metallic superalloy material and the consolidated metallic article (which melting points are typically the same or very close together). Pressing and solid-state sintering or extrusion of a canned material may also be used, particularly where the metallic superalloy material is in the form of a powder. The consolidation reduces the external dimensions of the mass of metallic superalloy material, but such reduction in dimensions is predictable with experience for particular compositions. The consolidation processing 50 may also be used to achieve further alloying of the metallic article with alloying elements such as nitrogen.

The consolidated metallic article, such as that shown in FIG. 1, may be used in its as-consolidated form. Instead, in appropriate cases the consolidated metallic article may optionally be thermomechanically post processed, step 52. Examples of post-processing metalworking include forging, extrusion, rolling, and the like. Some metallic compositions are amenable to such forming operations, and others are not. However, the superalloy article consolidated by the present approach will be much more amenable to forming operations than its equivalent cast-and-wrought composition due to its finer grain size and potential for superplastic forming. The consolidated metallic article may also or instead be optionally post-processed by other conventional metal processing techniques in step 52. Such post-processing may include, for example, joining, heat treating, surface coating, machining, and the like.

The metallic superalloy material is never heated above its melting point. Additionally, it may be maintained below specific temperatures that are themselves below the melting point, such as various precipitate (e.g., gamma prime, gamma-double-prime, or carbide) solvus temperatures.

In other cases such as some airframe components and structures, it is desirably to heat the alloy above a particular temperature to achieve a desirable solid-state phase or chemical reaction. In this case, the metallic alloy may be heated to temperatures above such a temperature during the processing, but in any case not above the melting point of the alloy.

The microstructural type, morphology, and scale of the article is determined by the starting materials and the processing. The grains of the articles produced by the present approach generally correspond to the morphology and size of the powder particles of the starting materials, when the solid-phase reduction technique is used. In the present approach, the metal is never melted and cooled from the melt, so that the coarse grain structure associated with the solidified structure never occurs. In conventional melt-based practice, subsequent metalworking processes are designed to break up and reduce the coarse grain structure associated with solidification. Such processing is not required in the present approach.

The present approach processes the mixture of nonmetallic precursor compounds to a finished metallic form without the metal of the finished metallic form ever being heated above its melting point. Consequently, this process enables the production of alloys with thermophysical melt incompatibilities. In addition, the process avoids the costs associated with melting operations, such as controlled-atmosphere or vacuum furnace costs. The microstructures associated with melting, typically large-grained structures, casting irregularities, and segregation-related irregularities (e.g., freckles, white spots, and eutectic nodules), are not found. Without such irregularities, the reliability or the articles is improved. The greater confidence in the irregularity-free state of the article, achieved with the better inspectability discussed above, also leads to a reduction in the extra material that must otherwise be present. Mechanical properties such as static strength and fatigue strength are improved, potentially allowing the articles to be lighter in weight. Inspectability is improved, and the product has reduced cost, irregularities, and porosity, as compared with the product of other powder metallurgy processing.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an article of a base metal alloyed with an alloying element, comprising the steps of providing a chemically reducible nonmetallic base-metal precursor compound of a base metal selected from the group consisting of nickel, cobalt, iron, iron-nickel, and iron-nickel-cobalt;

providing a chemically reducible nonmetallic alloying-element precursor compound of an alloying element, wherein the alloying element is thermophysically melt incompatible with the base metal; thereafter mixing the base-metal precursor compound and the alloying-element precursor compound to form a compound mixture; thereafter chemically reducing the compound mixture to produce a metallic superalloy without melting the metallic superalloy; and thereafter consolidating the metallic superalloy to produce a consolidated metallic article, without melting the metallic superalloy and without melting the consolidated metallic article.

2. The method of claim 1, wherein the step of providing the chemically reducible nonmetallic base-metal precursor compound includes the step of providing the chemically reducible nonmetallic base-metal precursor compound in a finely divided solid form, and wherein the step of providing the chemically reducible nonmetallic alloying-element precursor compound includes the step of providing the chemically reducible nonmetallic alloying-element precursor compound in a finely divided solid form.

3. The method of claim 1, wherein the step of providing the chemically reducible nonmetallic base-metal precursor compound includes the step of providing the chemically reducible nonmetallic base-metal precursor compound in a gaseous form, and wherein the step of providing the chemically reducible nonmetallic alloying-element precursor compound includes the step of providing a chemically reducible nonmetallic alloying-element precursor compound in a gaseous form.

4. The method of claim 1, wherein the step of providing a chemically reducible nonmetallic base-metal precursor compound includes the step of providing a chemically reducible base-metal oxide.

5. The method of claim 1, wherein the step of providing the chemically reducible nonmetallic alloying-element precursor compound of the alloying element includes the step of providing a chemically reducible alloying-element oxide.

6. The method of claim 1, wherein the step of mixing includes the step of furnishing the mixture comprising more nickel than any other metallic element.

7. The method of claim 1, wherein the step of mixing includes the step of furnishing the mixture comprising more cobalt than any other metallic element.

8. The method of claim 1, wherein the step of mixing includes the step of furnishing the mixture comprising more iron than any other metallic element.

9. The method of claim 1, wherein the step of mixing includes the step of furnishing the mixture comprising more (iron plus nickel) than any other metallic element.

10. The method of claim 1, wherein the step of mixing includes the step of furnishing the mixture comprising more (iron plus nickel plus cobalt) than any other metallic element.

11. The method of claim 1, wherein the step of chemically reducing includes the step of chemically reducing the compound mixture by solid-phase reduction.

12. The method of claim 1, wherein the step of chemically reducing includes the step of chemically reducing the compound mixture by fused salt electrolysis.

13. The method of claim 1, wherein the step of chemically reducing includes the step of chemically reducing the compound mixture by vapor-phase reduction.

14. The method of claim 1, wherein the step of providing the chemically reducible nonmetallic alloying-element precursor compound of the alloying element includes the step of providing the chemically reducible nonmetallic alloying-element precursor compound of the alloying element, wherein the alloying element has a vapor pressure of greater than about 10 times a vapor pressure of the base metal in a melt of the base metal, both measured at a melt temperature.

15. The method of claim 1, wherein the step of providing the chemically reducible nonmetallic alloying-element precursor compound of the alloying element includes the step of providing the chemically reducible nonmetallic alloying-element precursor compound of the alloying element, wherein the alloying element has a melting point different from that of the base metal by more than about 400° C.

16. The method of claim 1, wherein the step of providing the chemically reducible nonmetallic alloying-element precursor compound of the alloying element includes the step of providing the chemically reducible nonmetallic alloying-element precursor compound of the alloying element, wherein the alloying element has a density difference with the base metal of greater than about 0.5 gram per cubic centimeter.

17. The method of claim 1, wherein the step of providing the chemically reducible nonmetallic alloying-element precursor compound of the alloying element includes the step of providing the chemically reducible nonmetallic alloying-element precursor compound of the alloying element, wherein the alloying element, if melted, chemically reacts with the base metal in a liquid phase to form chemical compounds including the base metal and the alloying element.

18. The method of claim 1, wherein the step of providing the chemically reducible nonmetallic alloying-element precursor compound of the alloying element includes the step of providing the chemically reducible nonmetallic alloying-element precursor compound of the alloying element, wherein the alloying element, if melted, exhibits a miscibility gap with the base metal in the liquid phase.

19. The method of claim 1, wherein the step of providing the chemically reducible nonmetallic alloying-element precursor compound of the alloying element includes the step of providing the chemically reducible nonmetallic alloying-element precursor compound of the alloying element, wherein the alloying element, if melted, chemically reacts with the crucible material or the melting atmosphere.

20. The method of claim 11, including an additional step, after the step of providing a chemically reducible nonmetallic alloying-element precursor compound, of introducing an other additive constituent.

* * * * *